United States Patent [19]

Miyahara

[11] Patent Number: 4,913,854

[45] Date of Patent: Apr. 3, 1990

[54] WATER WARMING METHOD AND APPARATUS THEREFOR

[75] Inventor: Kingo Miyahara, Tokyo, Japan

[73] Assignee: Dowa Co., Ltd., Tokyo, Japan

[21] Appl. No.: 289,280

[22] Filed: Dec. 23, 1988

[30] Foreign Application Priority Data

Dec. 25, 1987 [JP] Japan ..... 62-329306

[51] Int. Cl.[4] ..... B01F 3/04

[52] U.S. Cl. ..... 261/92; 261/120

[58] Field of Search ..... 261/92, 120

[56] References Cited

U.S. PATENT DOCUMENTS

| | | | |
|---|---|---|---|
| 69,357 | 10/1867 | Moore | 261/92 |
| 131,266 | 9/1972 | Fuller | 261/92 |
| 249,719 | 11/1881 | Woodhouse | 261/92 |
| 444,300 | 1/1891 | Mooney | 261/92 |
| 444,945 | 1/1891 | Theisen | 261/92 |
| 462,102 | 10/1891 | Schmid | 261/92 |
| 1,018,243 | 2/1912 | Heenan | 261/92 |
| 1,462,363 | 7/1923 | Christensen | 261/92 |
| 1,528,204 | 3/1925 | Greenawalt | 261/92 |
| 1,644,089 | 10/1927 | Salerni | 261/92 |
| 3,109,875 | 11/1963 | Schramm et al. | 261/92 |
| 3,561,738 | 2/1971 | Galeano | 261/92 |
| 3,653,641 | 4/1972 | Eron | 261/120 |
| 3,759,495 | 9/1973 | Boler et al. | 261/92 |
| 3,804,155 | 4/1974 | Glicksman | 261/92 |
| 4,308,037 | 12/1981 | Meissner et al. | 261/92 |
| 4,762,539 | 8/1988 | Muto | 261/92 |

FOREIGN PATENT DOCUMENTS

| | | | |
|---|---|---|---|
| 90365 | 5/1922 | Austria | 261/92 |
| 60215 | 10/1954 | France | 261/92 |
| 6520 | 10/1894 | Sweden | 261/92 |
| 615010 | 12/1979 | Switzerland | 261/120 |
| 961488 | 6/1964 | United Kingdom . | |
| 1306678 | 2/1973 | United Kingdom . | |

*Primary Examiner*—Tim Miles

*Attorney, Agent, or Firm*—Pollock, Vande Sande & Priddy

[57] ABSTRACT

A water warming apparatus generates hot air bubbles by drawing and discharging a water in a water tank by a rotary body and plunging the water so drawn into the water together with a hot air introduced in a hot air chamber so as to cause direct heat exchange to be conducted and thereby make the water warm very quickly.

15 Claims, 5 Drawing Sheets

WATER WARMING METHOD AND APPARATUS THEREFOR

BACKGROUND OF THE INVENTION

1. Field of the Invention:

The present invention relates to a water warming method and an apparatus therefor which are capable of warming the water contained in a water tank very quickly.

2. Description of the Related Art:

Japanese Utility Model Publication No. 52-18440 discloses a submerged heater apparatus which is capable of heating a liquid by ejecting high temperature combustion gas directly into the liquid and thereby conducting a direct heat exchange between the high temperature combustion gas and the liquid. In this heater apparatus, a high temperature combustion gas ejecting pipe also serving as a combustion chamber which is provided coaxially with respect to a mixing chamber of a burner is put into a liquid contained in a liquid tank to a suitable depth at the central portion of the tank, and a high temperature combustion gas which is obtained in the pipe is ejected into the liquid from a large number of small holes formed in an umbrella type diffusing plate provided at the end of the pipe, so as to generate bubbles in the liquid. The liquid is vigorously stirred by the bubbles generated, and is heated by virtue of direct heat exchange conducted between the bubbles and the liquid.

However, the conventional heater apparatus of the above-described type has a disadvantage in that, since high temperature combustion gas obtained in the burner is ejected directly into the liquid through the ejecting pipe placed in the liquid, the ejecting pressure of the combustion gas must be raised to a value equivalent to a water head or above to enable the gas to be ejected into the liquid, requiring a special pressure raising device for raising the pressure of the ejecting gas to a sufficient value. This increases the size and production cost of the heater apparatus and limits the application field of the apparatus.

SUMMARY OF THE INVENTION

In view of the above-described problem of the conventional heater apparatus, an object of the present invention is to provide a water warming method and an apparatus therefor, which are capable of warming a water very quickly, even when the pressure of a heated air is not high, by plunging a heated air in a hot air chamber deeply into the water contained in a water tank together with water which is drawn so as to generate innumerable hot air bubbles in the water and thereby conducting heat exchange.

DESCRIPTION OF THE PREFERRED EMBODIMENTS

Figure 1:
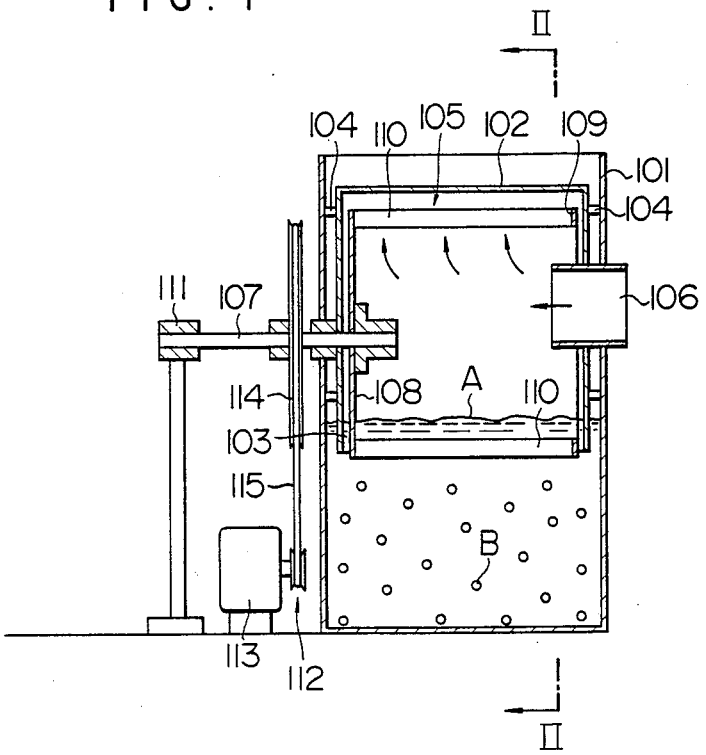
FIG. 1 is a vertical cross-sectional view of a water warming apparatus, showing a first embodiment of the present invention.
Figure 2:
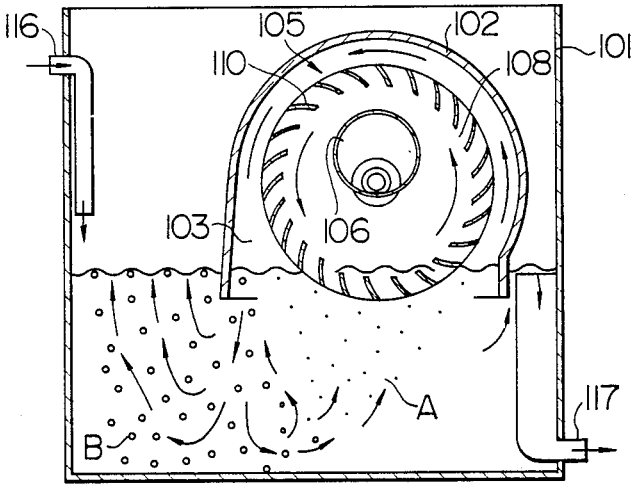
FIG. 2 is a section taken along the line II—II of FIG. 1.
Figure 3:
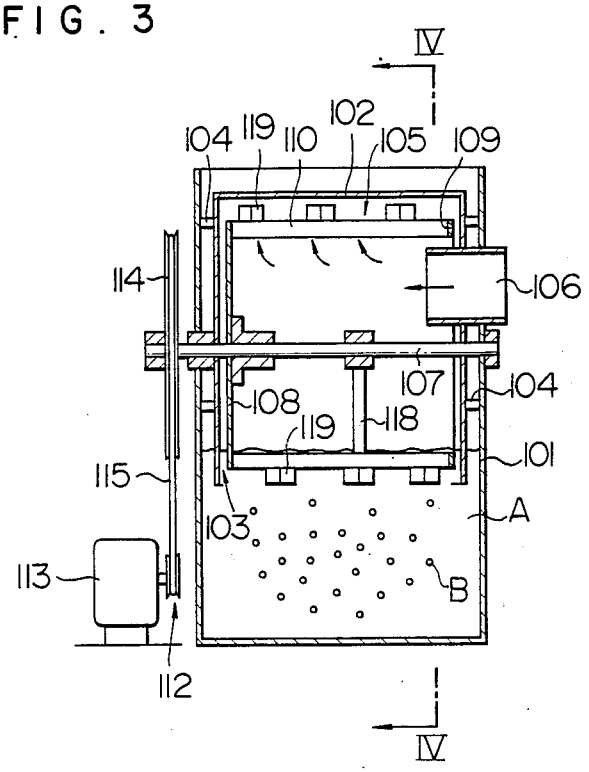
FIG. 3 is a vertical cross-sectional view of a water warming apparatus, showing a second embodiment of the present invention.
Figure 4:
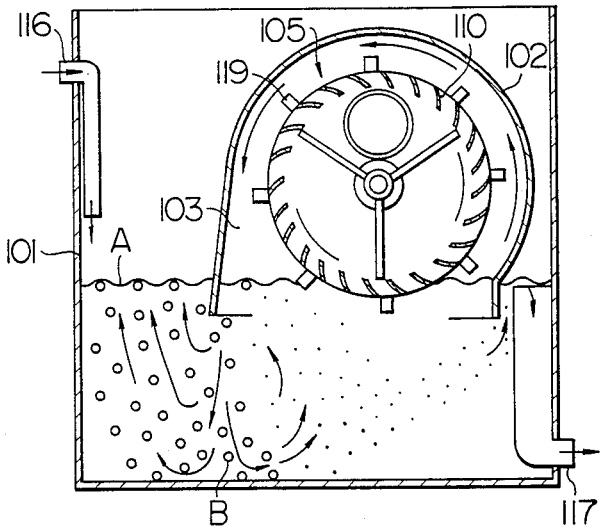
FIG. 4 is a section taken along the line IV—IV of FIG. 3.
Figure 5:
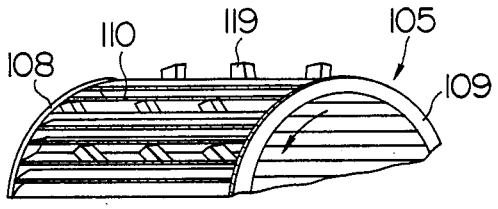
FIG. 5 is an enlarged perspective view of part of a rotary body of FIG. 3.

In the embodiment shown in FIGS. 1 and 2, a water tank 101 having an adequate size contains a water A. The water tank 101 is open at the upper surface thereof. A hot air chamber 102 having a substantially semi-circular form is fixedly disposed on the surface of the water contained in the water tank 101 by means of supporting members 104 in a state where a lower open portion 103 of the hot air chamber 102 faces the surface of the water. The hot air chamber 102 accommodates a rotary body 105. In the hot air chamber 102, the rotary body 105 is mounted on a rotary shaft 107 rotatably extending horizontally from a bearing body 111 and the water tank 101 in such a manner that it can be rotated in one direction. The rotary body 105 have the function of drawing and discharging the water A into the hot air chamber 102 by a lower portion thereof which is immersed in the water A, conveying the drawn water along the inner wall of the hot air chamber 102, and plunging it into the water deeply from the lower open portion 103. Also, the rotary body 105 is capable of conveying a heated air introduced into the hot air chamber 102 from a hot air inlet 106 along the inner wall thereof and throwing a mixture of the water drawn and the heated air deeply into the water A.

The rotary body 105 has a blind disk 108 and an annular plate 109, and a large number of stirring members 110 for drawing and discharging water. The stirring members 110 extend between the blind disk 108 and the anular plate 109 and are aligned on the circumferences of the blind disk and the annular plate. The hot air inlet 106 is provided on the side of the apparatus where the annular disk 109 is disposed. A heated air, such as combustion gas of a fuel gasified burner or hot vapor or hot air obtained utilizing waste heat recovery, is introduced toward the rotary body 105 from the hot air inlet 106. A driving device 112 for rotating the rotary body 105 has a motor 113, and pulley 114 coupled to the rotary shaft 107, and a belt 115 for transmitting the rotation of the motor 113 to the pulley 114.

The water A is charged into the water tank 101 to a predetermined level from a water supply pipe 116, and a hot water is automatically discharged from a discharge pipe 117 so as to maintain the predetermined level.

The operation of the embodiment shown in FIGS. 1 and 2 will be described below.

First, the hot air chamber 102 is disposed on the surface of the water A contained in the water tank 101 in such a manner that the lower open portion 103 of the hot air chamber 102 faces the surface of the water A. Subsequently, the rotary body 105 which is rotatably accommodated in the hot air chamber 102 in such a manner, that the lower portion of the rotary body 105 is immersed in the water A, is rotated in the direction indicated by the arrows while the heated air is introduced into the hot air chamber 102 from the hot air inlet 106.

As a result, the water A in the water tank 101 is efficiently drawn by the rotary body 105, and the drawn water is conveyed along the inner wall of the hot air chamber 102 in the direction indicated by the arrows, and is then vigorously thrown to the surface of the water A from the lower open portion 103 of the hot air chamber 102. Concurrently with this, the rotary body 105 sends the heated air which is introduced into the hot air chamber 102 along the inner wall of the hot air chamber 102 in the direction indicated by the arrows, part of the heated air being mixed with the water A drawn within the hot air chamber 102 and the mixture being vigorously thrown against the water A in the water tank 101 from the lower open portion 103. At this time, part of the heated air in the hot air chamber 102 is also drawn into the water when the rotary body 105 strikes the surface of the water strongly and plunges into it.

Thus, the water A which is drawn and the heated air introduced are vigorously plunged into the water contained in the water tank 101 from the hot air chamber 102 by virtue of the rotation of the rotary body 105, generating innumerable bubbles B of hot air in the water. While these innumerable bubbles B float up to the surface of the water A, heat exchange is conducted in the water by means of direct heating of the water A by the hot air bubbles B, and the water A in the water tank 101 thus becomes warm very quickly.

A second embodiment of the present invention will be described below with reference to FIGS. 3 to 6.

In this water warming apparatus shown in FIGS. 3 to 6, the hot air chamber 102 is disposed on the surface of the water A contained in the water tank 101 in such a manner that the lower open portion 103 of the hot air chamber 102 faces the surface of the water A. Subsequently, the rotary body 105 which is rotatably accommodated in the hot air chamber 102 in such a manner that the lower portion of the rotary body 105 is immersed in the water A is rotated in the direction indicated by the arrows while a heated air is introduced into the hot air chamber 102 from the hot air inlet 106.

Figure 6:
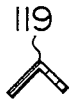
FIG. 6 is an enlarged cross-sectional view of a stirring piece of FIG. 3.

The rotary body 105 is mounted on a rotary shaft 107 which is rotatably and horizontally passed through the water tank 101, and is supported by a plurality of bearing poles 118 extending between the rotary shaft 107 and the stirring members 110. Each of the large number of stirring members 110 disposed on the circumference of the disk and the plate has a plurality of stirring pieces 119 on the peripheral surface thereof. Each of the stirring pieces 119 protrudes outwardly, and has a pointed portion, as shown in FIG. 6. The stirring piece may have another form. Other structure of the water warming apparatus of this embodiment is the same as that of the first embodiment shown in FIGS. 1 and 2.

In this water warming apparatus, the water A in the water tank 101 is efficiently drawn by the rotary body 105, and the water so drawn is conveyed along the inner wall of the hot air chamber 102 in the direction indicated by the arrows, and is then vigorously thrown to the surface of the water A from the lower open portion 103 of the hot air chamber 102. Concurrently with this, the rotary body 105 sends the heated air which is introduced into the hot air chamber 102 along the inner wall of the hot air chamber 102 in the direction indicated by the arrows, part of the heated air being mixed with the water A in the hot air chamber 102 and the mixture being vigorously thrown against the water A in the water tank 101 from the lower open portion 103. Thus, the water A which is drawn and the heated air introduced are plunged into the water contained in the water tank 101 from the hot air chamber 102 by virtue of rotation of the rotary body 105, generating innumerable bubbles B of hot air in the water. Provision of the plurality of stirring pieces 119 on the peripheral surface of the rotary body 105 which is rotated in the hot air chamber 102 in the direction indicated by the arrows allows the water in the water tank to be stirred effectively under the water surface, and enables the amount of water drawn and thrown to the surface of the water to be increased. It also allows the water A and the heated air to be effectively mixed with each other in the hot air chamber 102 and allows the mixture of the water and the hot air to be plunged deeply into the water, drawing the heated air in the hot air chamber 102 into the water and generating hot air bubbles B vigorously.

In consequence, while innumerable small hot air bubbles B float up to the surface of the water A, heat exchange is conducted efficiently in the water by means of direct heating of the water A by the small hot air bubbles B, and the water A in the water tank 101 thus becomes warm very quickly.

Next, a third embodiment of the present invention will be described below with reference to FIGS. 7 and 8.

Figure 7:
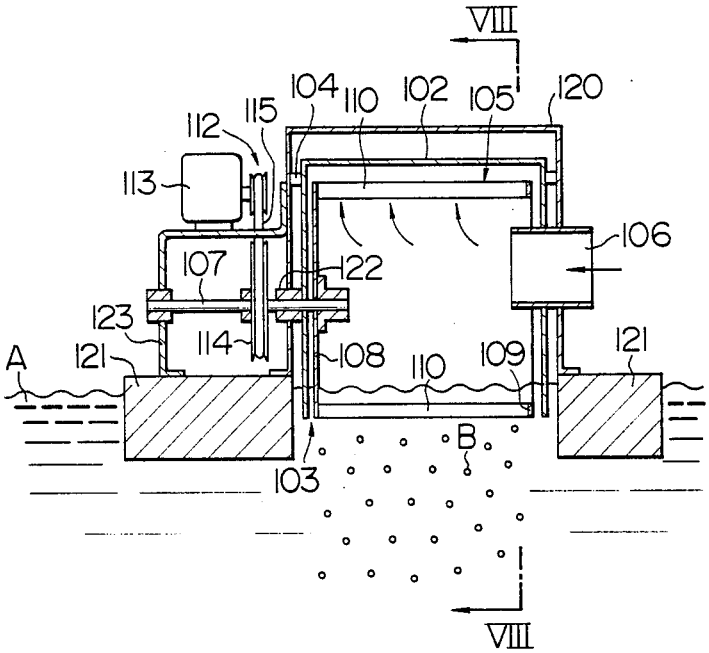
FIG. 7 is a cross-sectional view of a third embodiment of the present invention.
Figure 8:
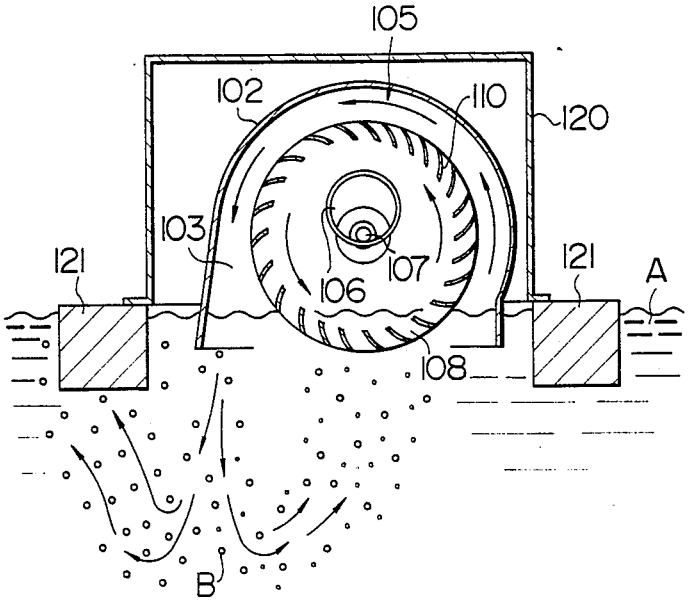
FIG. 8 is a section taken long the line VIII—VIII of FIG. 7.

A water warming apparatus shown in FIGS. 7 and 8 is used to effectively warm a large quantity of water A contained a swimming pool, a hot spring or a pond having a large area. The water warming apparatus includes a casing 120 which is opened at a lower portion, and a pair of floating bodies 121 provided at the two sides of the casing 120 for causing the casing 120 to float on the surface of the water at a desired position. The hot air chamber 102 having an open lower portion is accommodated in the casing 120. In the casing 120, the hot air chamber 102 is fixed to a bearing boss 122 of the rotary shaft 107 which is rotatably and horizontally extended between a bearing hausing 123 extending from the floating body 121 to the casing 120 and the bearing boss 122 provided on the casing 120. In the hot air chamber 102, the rotary body 105 having the same structure as that of the rotary body shown in FIGS. 1 and 2 is mounted on the rotary shaft 107 in such a manner that it can be rotated in the direction indicated by the arrows.

A driving device 112 for rotating the rotary body 105 in the direction indicated by the arrows has the motor 113 which is placed on the bearing housing 123, the pulley 114 coupled to the rotary shaft 107, and a belt 115 for transmitting the rotation of the motor to the pulley 114.

In this water warming apparatus, the hot air chamber 102 is caused to float on the surface of the water contained in the water tank 101 by the pair of floating bodies 121 in such a manner that the lower open portion 103 faces the surface of the water. Subsequently, the rotary body 105 which is rotatably accommodated in the hot air chamber 102 in such a manner that the lower portion of the rotary body 105 is immersed in the water A is rotated in the direction indicated by the arrows while a heated air is introduced into the hot air chamber 102 from the hot air inlet 106.

In consequence, the water A in the water tank 101 is efficiently drawn by virtue of the rotation of the rotary body 105, and the water drawn is conveyed along the inner wall of the hot air chamber 102 in the direction indicated by the arrows, and is then vigorously thrown against the water A from the lower open portion 103 of the hot air chamber 102. Concurrently with this, the rotary body 105 sends the heated air which is introduced into the hot air chamber 102 along the inner wall of the hot air chamber 102 in the direction indicated by the arrows, part of the heated air being mixed with the water A drawn within the hot air chamber 102 and the mixture being vigorously thrown against the water in the water tank 101 from the lower open portion 103. Thus, a mixture of the water A drawn and the heated air introduced is plunged into the water by virtue of the rotation of the rotary body 105, generating innumerable hot air bubbles B in the water. While these hot air bubbles B float up to the surface of the water, heat exchange is conducted in the water by means of direct heating of the water A by the hot air bubbles B, and the water in the water tank thus becomes warm very quickly.

Further, since the hot air chamber 102 is caused to float on the surface of the water by the floating bodies 121, the hot air chamber 102 can be moved to a desired position, allowing a water warming operation to be conducted readily at that position. This enables a large quantity of water A having a large surface area to be warmed.

Figure 9:
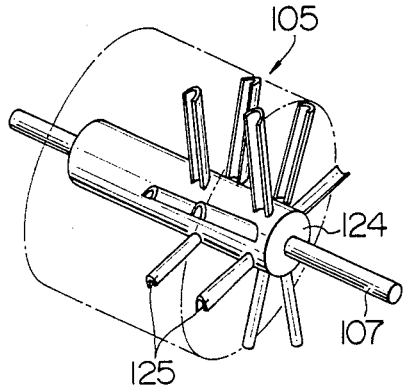
FIG. 9 is a perspective view, with part broken away, of another example of a rotary body.
Figure 10A:
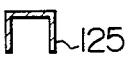
FIGS. 10A, 10B and 10C are respectively enlarged cross-sectional views of another examples of stirring bodies.
Figure 10B:
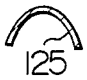
Figure 10C:
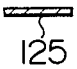
Figure 11:
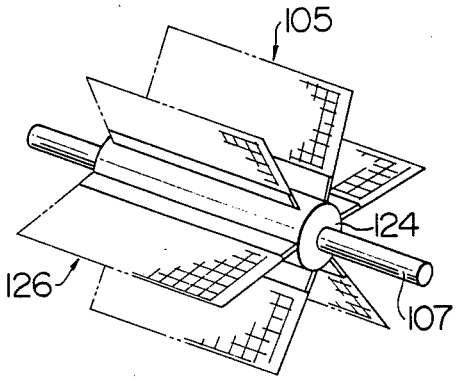
FIG. 11 is a perspective view of still another example of a rotary body with stirring bodies made of a wire mesh plate.
Figure 12:
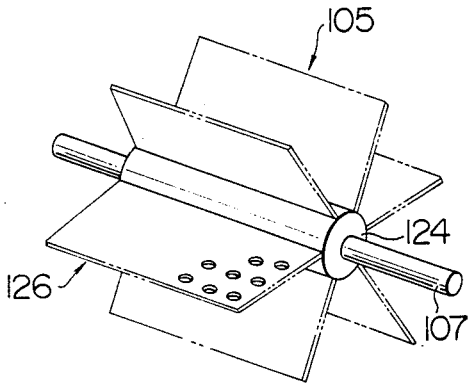
FIG. 12 is a perspective view of still another example of a rotary body with stirring bodies made of a perforated plate.

The rotary body 105 used in each of the above-described embodiments may also have the following structure. A rotary body 105 shown in FIG. 9 has a cylindrical boss 124 with a large number of stirring members 125 radially planted in the peripheral surface thereof, the boss cylinder being directly coupled to the rotary shaft 107. Each of the stirring members 125 shown in FIG. 9 has an inverted V-shaped cross-section. However, it may also have an inverted U-shaped cross-section, as shown in FIG. 10A, a semi-circular cross-section, as shown in FIG. 10B, a horizontal form, as shown in FIG. 10C, or a bar-like form. Alternatively, the rotary body 105 may have a cylindrical boss 124 with a plurality of stirring members 125 made of a metal mesh plate planted radially in the peripheral surface thereof, as shown in FIG. 11, or a cylindrical boss 124 with a plurality of stirring members 125 made of a perforated plate being planted radially in the peripheral surface of the cylindrical boss 124, as shown in FIG. 12.

As will be understood from the foregoing description of the present invention, part of the water A contained in the water tank 101 is drawn into the hot air chamber 102 by the rotary body 105 which is rotated in the hot air chamber 102 provided on the surface of the water in such a manner that the lower open portion 103 faces the surface of the water, and the water A so drawn is continuously plunged into the water contained in the water tank 101 together with the heated air introduced into the hot air chamber 102 by the rotation of the rotary body 105 so as to generate innumerable hot air bubbles B in the water. While these innumerable hot air bubbles B float up to the surface of the water, heat exchange is conducted in the water by means of direct heating of the water A by the hot air bubbles B, and the water A in the water tank 101 thus becomes warm very quickly. As a result, the heated air is plunged deeply into the water together with the water A drawn into the hot air chamber 102 so as to achieve an effective heat exchange. Further, provision of the plurality of stirring pieces 119 on the peripheral surface of the rotary body 104 allows the amount of water A drawn or plunged into the water to be increased, and accelerates the stirring conducted in the water in the water tank 101. This causes the heated air to be plunged into the water further deeply, generating more fine hot air bubbles B and thereby accelerating heat exchange operation. Even when the water A contained in a container having a large surface area is to be warmed, effective heat exchange can be conducted to make the water warm very quickly using the hot air chamber 102 and the rotary body 105 which are caused by float on the surface of the water by the floating bodies 121 so that they can be moved to a desired position.

What is claimed is:

1. A water warming method comprising the steps of:

drawing and discharging the water in a water tank into a hot air chamber which is positioned in said water tank and has a lower end disposed substantially on the water contained in said water tank by a rotary body accommodated in said hot air chamber;

introducing heated air into said hot air chamber; and continuously plunging said drawn water mixed with said heated air back into the water contained in said water tank, such as to generate hot air bubbles in the water causing direct heat exchange between the water and said hot air bubbles to quickly warm said water in said water tank.

2. A water warming apparatus, comprising:

a hot air chamber caused to float on the surface of a water by floating bodies in such a manner that a lower open portion thereof faces the surface of the water; and a rotary body accommodated in said hot air chamber, said rotary body being rotatably supported by a shaft in such a manner that a lower portion thereof is immersed in the water, said rotary body drawing and discharging the water and plunging the discharged water into the water together with a hot air introduced into said hot air chamber from a hot air inlet.

3. A water warming apparatus according to claim 2, wherein said rotary body has a plurality of stirring pieces on the peripheral surface thereof.

4. A water warming apparatus according to claim 3, wherein said rotary body has a blind disk and an annular plate, and a large number of stirring bodies extending between said blind disk and the annular plate, said stirring members being aligned on the circumference of said blind disk and the annular plate.

5. A water warming apparatus according to claim 3, wherein said rotary body has a cylindrical boss, and a large number of stirring members which are planted radially in the peripheral surface of said cylindrical boss.

6. A water warming apparatus according to claim 2, wherein said rotary body has a blind disk and an annular plate, and a large number of stirring bodies extending between said blind disk and the annular plate, said stirring members being aligned on the circumference of said blind disk and the annular plate.

7. A water warming apparatus according to claim 6, wherein said rotary body has a cylindrical boss, and a large number of stirring members which are planted radially in the peripheral surface of said cylindrical boss.

8. A water warming apparatus according to claim 2, wherein said rotary body has a cylindrical boss, and a large number of stirring members which are planted radially in the peripheral surface of said cylindrical boss.

9. A water warming apparatus, comprising:

a hot air chamber disposed on the water contained in a water tank, said hot air chamber having a lower open portion facing the surface of the water;

a hot air inlet for introducing hot air into said hot air chamber; and a rotary body provided in said hot air chamber, said rotary body being rotatably supported in said hot air chamber by a shaft such that the lower portion of said rotary body is immersed in the water, said rotary body drawing and discharging water into said hot air chamber and plunging said drawn water mixed with said hot air back into the water in said water tank, such as to generate hot air bubbles in the water, causing direct heat exchange between said water and said hot air bubbles to quickly warm said water in said water tank.

10. A water warming apparatus according to claim 9, wherein said rotary body has a cylindrical boss, and a large number of stirring members which are planted radially in the peripheral surface of said cylindrical boss.

11. A water warming apparatus according to claim 9, wherein said rotary body has a blind disk and an annular plate, and a large number of stirring members extending between said blind disk and the annular plate, said stirring members being aligned on the circumference of said blind disk and the annular plate.

12. A water warming apparatus according to claim 11, wherein said rotary body has a cylindrical boss, and a large number of stirring members which are planted radially in the peripheral surface of said cylindrical boss.

13. A water warming apparatus according to claim 9, wherein said rotary body has a plurality of stirring pieces on the peripheral surface thereof.

14. A water warming apparatus according to claim 13, wherein said rotary body has a blind disk and an annular plate, and a large number of stirring members extending between said blind disk and the annular plate, said stirring members being aligned on the circumference of said blind disk and the annular plate.

15. A water warming apparatus according to claim 13, wherein said rotary body has a cylindrical boss, and a large number of stirring members which are planted radially in the peripheral surface of said cylindrical boss.

* * * * *